US012187571B2

(12) United States Patent
Passarella

(10) Patent No.: US 12,187,571 B2
(45) Date of Patent: Jan. 7, 2025

(54) REEL HANDLING ROBOT AND A METHOD FOR HANDLING REELS OF WEB MATERIAL

(71) Applicant: Fameccanica.Data S.p.A., San Giovanni Teatino (IT)

(72) Inventor: Fabio Passarella, San Giovanni Teatino (IT)

(73) Assignee: Fameccanica.Data S.p.A., San Giovanni Teatino Chieti (IT)

( * ) Notice: Subject to any disclaimer, the term of this patent is extended or adjusted under 35 U.S.C. 154(b) by 100 days.

(21) Appl. No.: 18/079,362

(22) Filed: Dec. 12, 2022

(65) Prior Publication Data

US 2023/0183037 A1 Jun. 15, 2023

(30) Foreign Application Priority Data

Dec. 13, 2021 (EP) ..... 21214133

(51) Int. Cl.
*B65H 75/24* (2006.01)

(52) U.S. Cl.
CPC ..... *B65H 75/24* (2013.01); *B65H 2301/4135* (2013.01); *B65H 2301/41722* (2013.01); *B65H 2555/11* (2013.01)

(58) Field of Classification Search
CPC ..... B65H 19/123
See application file for complete search history.

(56) References Cited

U.S. PATENT DOCUMENTS

| | | | | |
|---|---|---|---|---|
| 4,821,972 | A * | 4/1989 | Grollimund | B65H 19/123 901/6 |
| 6,733,058 | B1 * | 5/2004 | Nakajima | B66C 1/54 294/67.5 |
| 2016/0060059 | A1 * | 3/2016 | Macura | B65H 19/123 242/555.1 |
| 2016/0060060 | A1 * | 3/2016 | Macura | B65H 16/04 242/558 |
| 2017/0233206 | A1 * | 8/2017 | Wimmer | B65H 19/123 242/554 |
| 2018/0079542 | A1 * | 3/2018 | Hashimoto | B65H 19/123 |
| 2018/0141772 | A1 * | 5/2018 | Prankl | B65H 19/12 |
| 2021/0122597 | A1 * | 4/2021 | Hernando Saiz | B65H 19/30 |
| 2023/0033033 | A1 * | 2/2023 | Wehrmann | B41J 15/165 |
| 2024/0051779 | A1 * | 2/2024 | Peutl | B65H 19/30 |

FOREIGN PATENT DOCUMENTS

| | | |
|---|---|---|
| DE | 202016104946 U1 | 10/2017 |
| DE | 102016116800 A1 | 3/2018 |

OTHER PUBLICATIONS

European Search Report dated May 3, 2022. 6 pages.

* cited by examiner

*Primary Examiner* — William A. Rivera
(74) *Attorney, Agent, or Firm* — RMCK Law Group PLC

(57) ABSTRACT

A reel handling robot for handling reels of web material, includes a movable arm carrying an end effector having a base, a reel picking tool, and a web gripping tool configured for gripping a head portion of a web on an outer surface of the reel.

7 Claims, 11 Drawing Sheets

REEL HANDLING ROBOT AND A METHOD FOR HANDLING REELS OF WEB MATERIAL

CROSS-REFERENCE TO RELATED APPLICATION

This application claims priority to European Patent Application No. 21214133.7 filed Dec. 13, 2021. The disclosure of the above application is incorporated herein by reference in its entirety.

FIELD OF THE INVENTION

The present invention relates to a reel handling robot for handling reels of web material such as, for example, non-woven webs, paper webs, elastic laminates, and the like.

The invention has been developed in particular for the application in the field of the production of absorbent sanitary articles.

In the following description, reference will be made to this specific field without however losing generality.

DESCRIPTION OF THE PRIOR ART

A reel of web material generally has a tubular core, e.g. of cardboard, around which the web material is wound. Reels of web material are formed on a winding apparatus situated at the end of a production machine. The winding apparatus has a winding shaft on which an empty tubular core may be placed. In the winding apparatus the web material is wound around the tubular core until the desired dimension of the reel is reached. Reels of web material used in machines for manufacturing absorbent articles generally have a width equal to the width of the web material and a diameter in the order of 1-1.5 meters. When the formation of the reels is completed, the reels are transported to a storage area close to a converting machine.

Before being used in a converting machine, reels of web material are usually subjected to a preliminary preparation in which the outer turn of web material is removed, and an adhesive element is applied to the head portion of the web material.

Modern machines for producing absorbent sanitary articles operate at increasingly higher speeds, so that the speed of unwinding of the web materials from the reels tends to become faster and faster, increasing the frequency with which the finished reels are replaced with new reels.

Replacing a finished reel with a new reel must be carried out by maintaining continuity between the web material coming from the reel close to finishing and the web material coming from the new reel, in order not to interrupt the operation of the converting machine. The continuity of the web material is obtained by splicing the tail portion of the web unwinding from a reel close to finishing with the head portion of a web unwound from a new reel, usually made by a double-sided adhesive element applied on the head portion of the new reel.

In view of the high frequency of replacement of the reels, there is a need for apparatuses for automatically loading new reels on the unwinders of the converting machines and for automatically splicing the web materials.

Solutions are known that envisage carrying out the preparation of the edges and the joint between the webs of two reels directly on the unwinding unit of the converting machine. One example of this prior art is described in EP-A-1277683 by the same Applicant.

Preparation of the edges of the reels carried out directly on the unwinding units could cause the machine to stop in case of malfunctions or jams of the automatic device for preparing the edges.

For this reason, it may be preferable to carry out the preparation of the edges of the reels off-line in order to load the reels—with the edges ready for splicing—onto the unwinding assemblies of the machine for producing absorbent sanitary articles.

In any case, the prior art requires first robots for automatically loading new reels on the unwinding units of the converting machines and second robots for threading the head portion of the web material coming from a new reel on a splicer.

The prior art solutions tend to be complex and expensive.

There is therefore a need to provide apparatuses for handling reels which are simpler and less expensive.

OBJECT AND SUMMARY OF THE INVENTION

The object of the present invention is to provide a reel handling robot and a method for handling reels of web material that meet the above needs.

According to the present invention, this object is achieved by a reel handling robot for handling reels of web material having the characteristics forming the subject of claim 1.

The claims form an integral part of the disclosure provided here in relation to the invention.

BRIEF DESCRIPTION OF THE DRAWINGS

The present invention will now be described in detail with reference to the attached drawings, given purely by way of non-limiting example, wherein.

DETAILED DESCRIPTION

Figure 1:
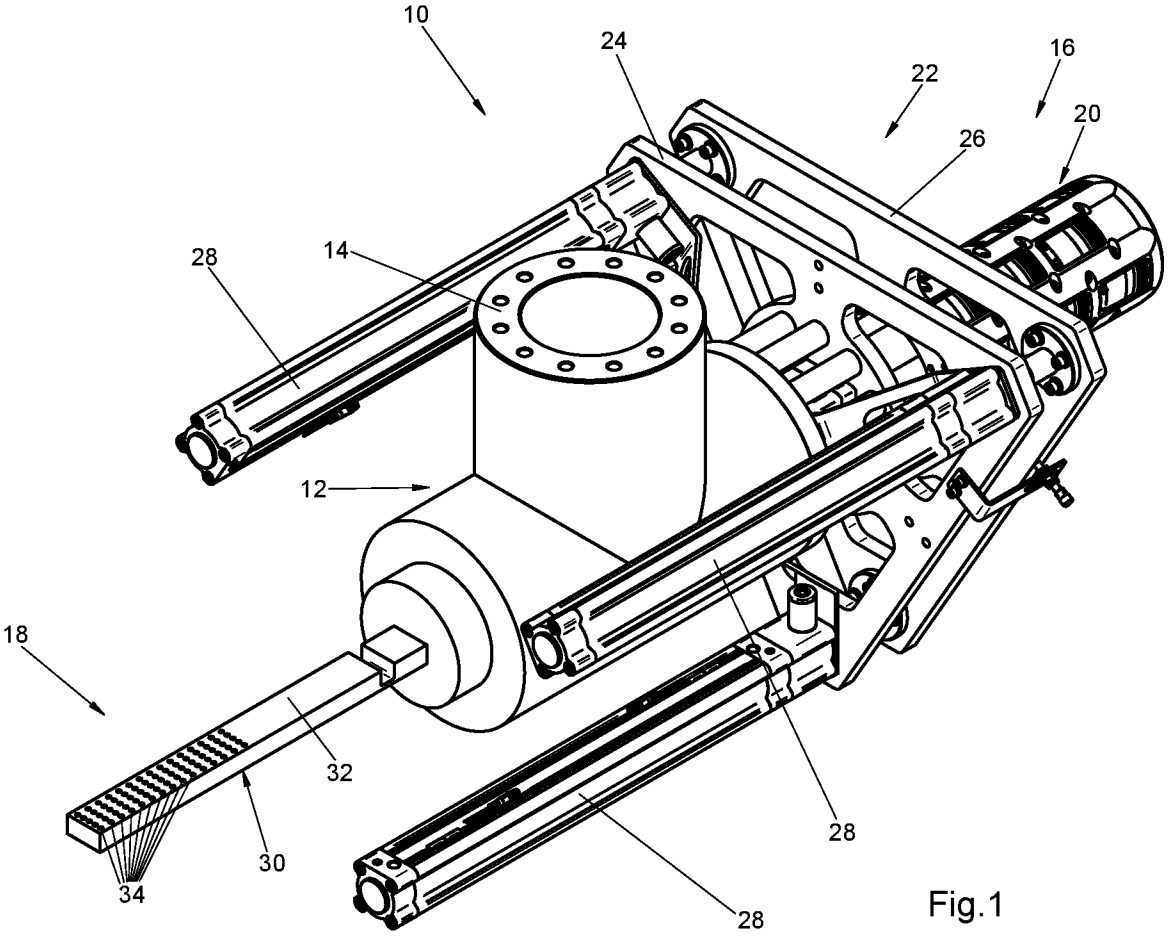
FIGS. 1 and 2 are perspective views from different angles of an end effector of a reel handling robot according to the present invention.
Figure 2:
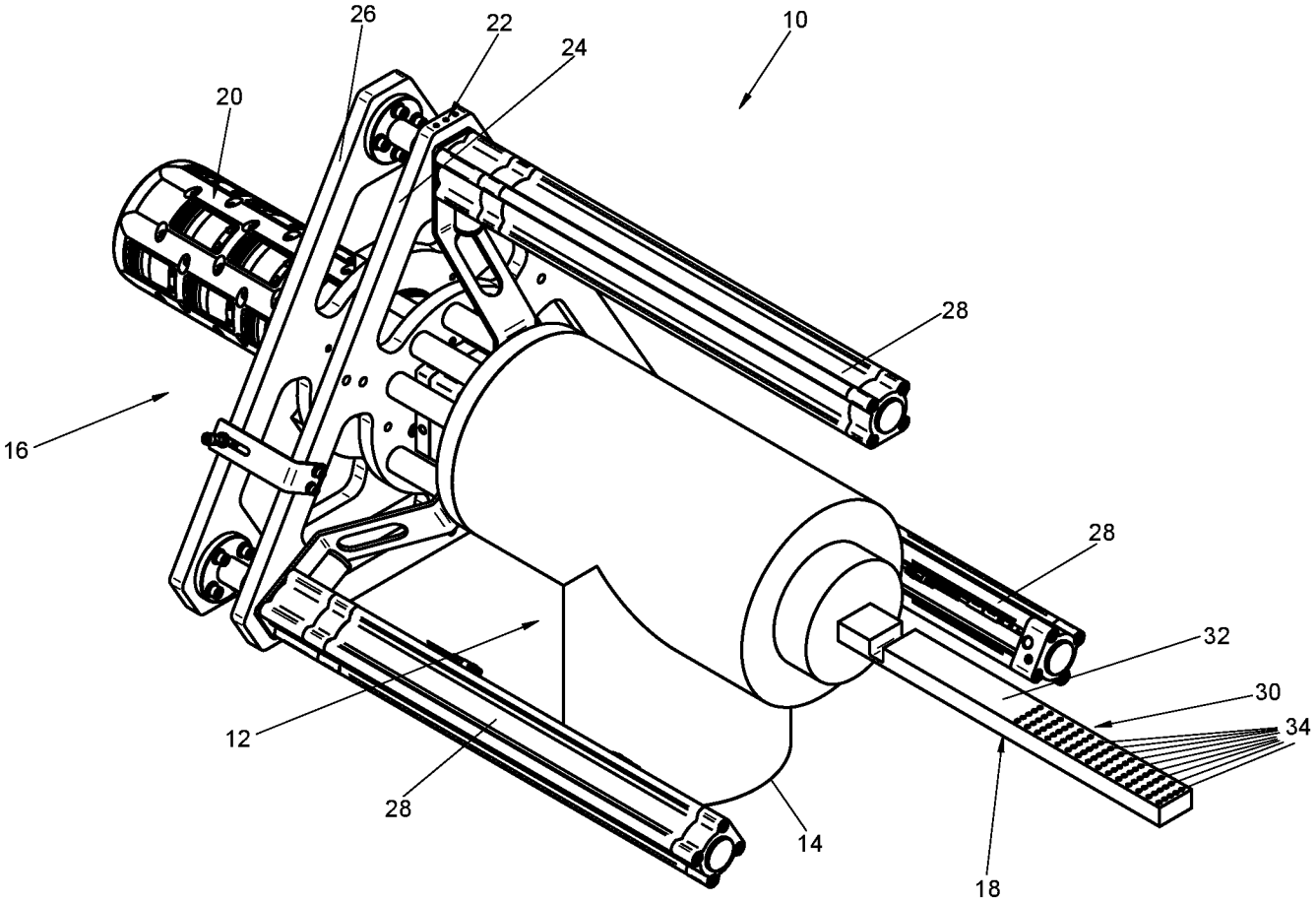

With reference to FIGS. 1 and 2, numeral 10 indicates an end effector for a reel handling robot.

The end effector 10 comprises a base 12 having a flange 14 configured for attachment to a robot.

The end effector 10 comprises a reel picking tool 16 and a web gripping tool 18, both carried by the base 12.

The reel picking tool 16 comprises an expansion shaft 20 configured for being inserted into the central hole of a reel. The expansion shaft 20 has radially movable engagement elements controlled by an actuator (not shown) which expand radially to engage the cylindrical inner surface of a reel after the expansion shaft 20 has been inserted into the central hole of a reel.

The reel picking tool 16 may comprise an extractor device 22 including a first plate 24 fixed to the base 12 and a second plate 26 movable along the axis of the expansion shaft 20 between a retracted position and an extracted position. The movement of the second plate 26 may be controlled by three linear actuators 28 carried by the first plate 24.

The web gripping tool 18 may comprise a rod 30 which may have a flat surface 32 having suction holes 34 connectable to a source of sub-atmospheric pressure. The web gripping tool 18 may be located on the side of the base 12 opposite to the reel picking tool 16.

With reference to FIGS. 3-10, the end effector 10 is carried by a reel handling robot 36. The reel handling robot 36 may be a cartesian robot, as shown in the figures, an anthropomorphic robot or any other type of industrial robot. The reel handling robot 36 comprises a movable arm 38 configured for moving the end effector 10 along three orthogonal axes X, Y, Z and for rotating the end effector 10 about the same axes X, Y, Z.

The reel handling robot 36 is arranged to serve an unwinding unit 40 of a converting machine. The unwinding unit 40 comprises a plurality of unwinding shafts 42. The unwinding shafts 42 are arranged in pairs and each pair of unwinding shafts 42 is associated to a respective splicer 44. The splicers 44 may be constructed as disclosed in U.S. Pat. No. 7,708,043 of the same Applicant.

The reel handling robot 36 is configured for picking reels 46 placed in a storage area 48 and for loading the reels on the unwinding shafts 42. The reels 46 are formed by a continuous web material wound to form a cylindrical reel. The continuous web material may be a non-woven material, an elastic laminate, a paper web, or the like. The continuous web material may be wound around a tubular core, e.g. of cardboard. Each reel 46 has a central hole 47 having a cylindrical inner surface.

The reels 46 placed in the storage area 48 have already been prepared for splicing. In particular, a double-sided adhesive tape 50 is applied on the outer surface of each reel 46 adjacent to the head edge of the web material. The outer surface of the double-sided adhesive tape 50 may have a removable protective film to protect the outer adhesive surface.

The reel handling robot 36 operates under the control of an electronic control unit 51 which is programmed to implement a method for handling reels as disclosed in the following.

Figure 3:
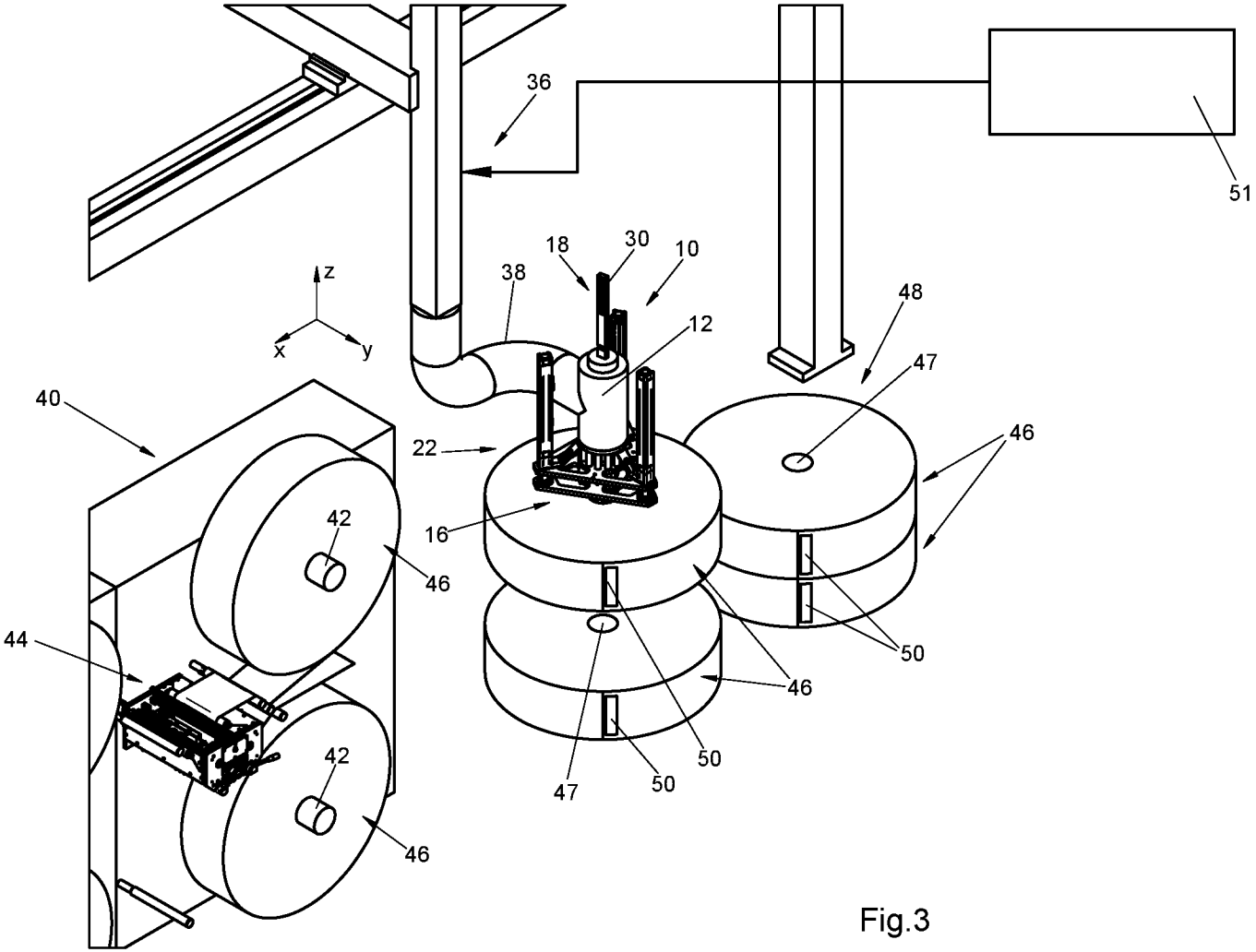
FIGS. 3-10 are perspective views showing the sequence of operation of reel handling robot according to the present invention.

With reference to FIG. 3, in a first step the reel handling robot 36 moves the end effector 10 to insert the expansion shaft 20 into the central hole 47 of a reel 46 placed in the storage area 48. Then, the expansion shaft 20 is expanded radially to engage the cylindrical inner surface of the reel 46 to secure the reel 46 to the base 12 of the end effector 10.

Figure 4:
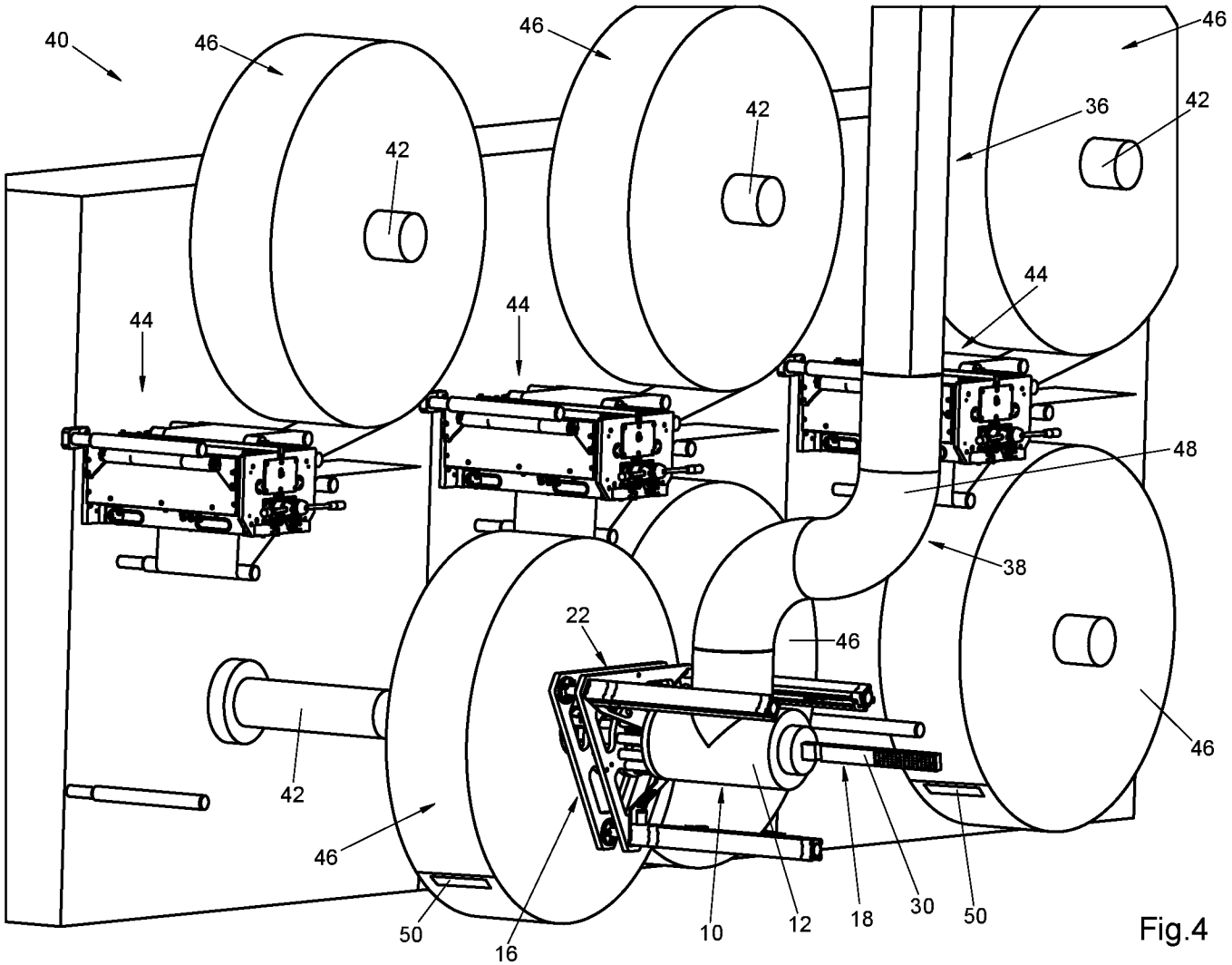

Then, as shown in FIG. 4, the reel handling robot 36 moves the end effector 10 to align the expansion shaft 20 to a free unwinding shaft 42 of the unwinding unit 40.

Figure 5:
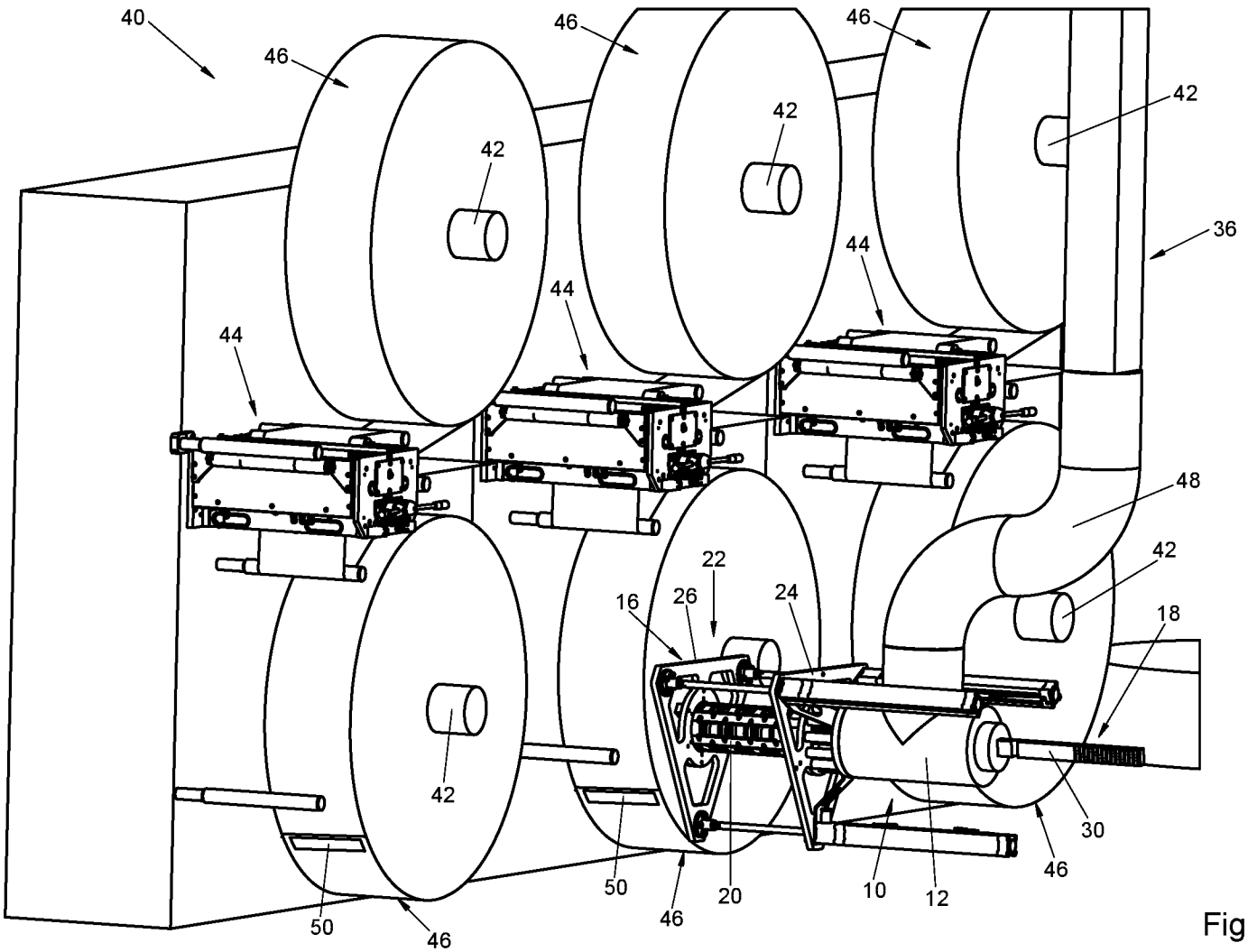

Then, as shown in FIG. 5, the extractor device 22 of the end effector 10 is actuated to move the second plate 26 from the retracted position to the extracted position, so that the reel 46 is transferred from the expansion shaft 20 of the end effector 10 to the free unwinding shaft 42 of the unwinding unit 40.

Figure 6:
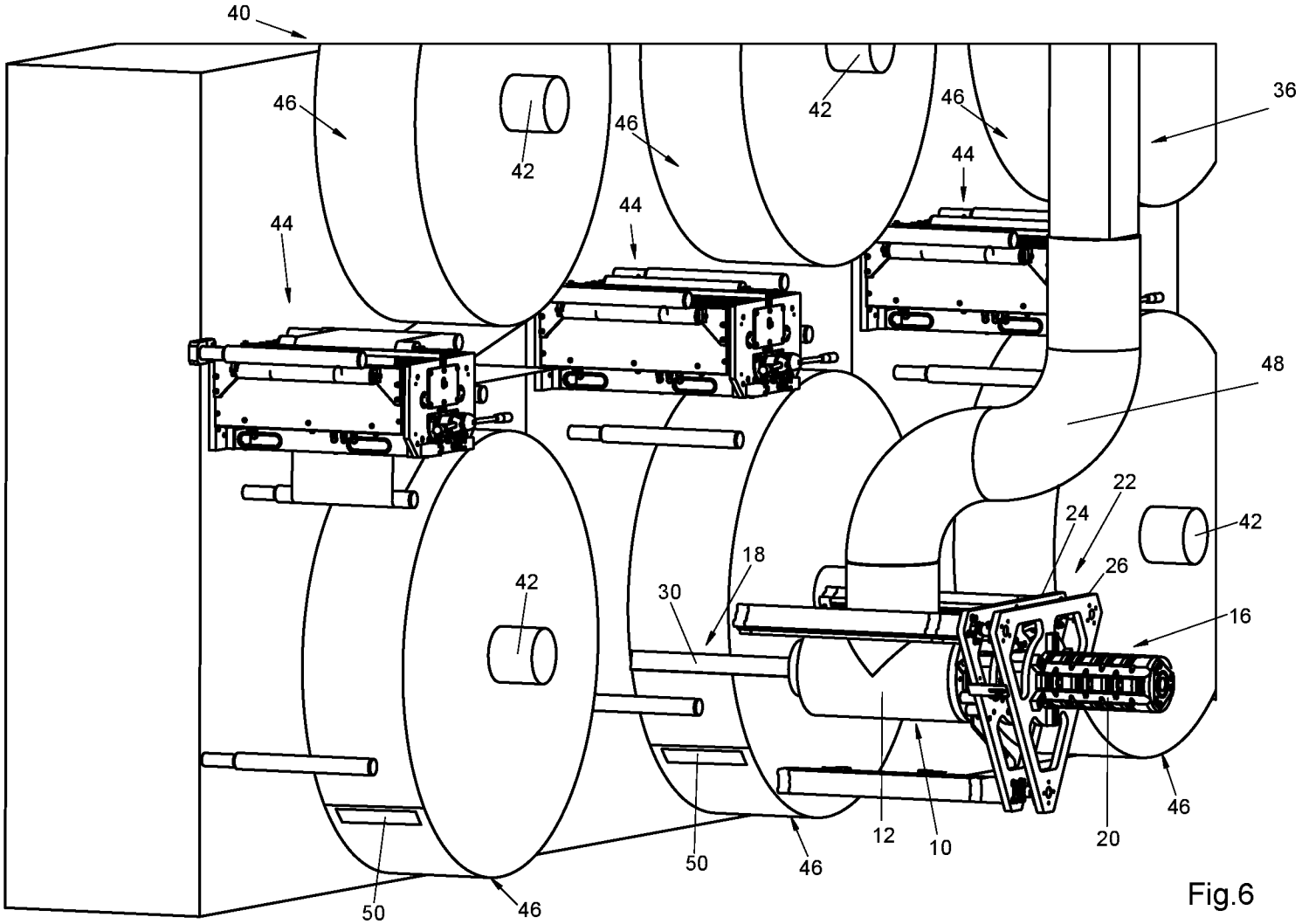

With reference to FIG. 6, after having transferred the reel 46 to the free unwinding shaft 42 of the unwinding unit 40, the end effector 10 is rotated 180° to bring the web gripping tool 18 in a position facing the unwinding unit 40.

Figure 7:
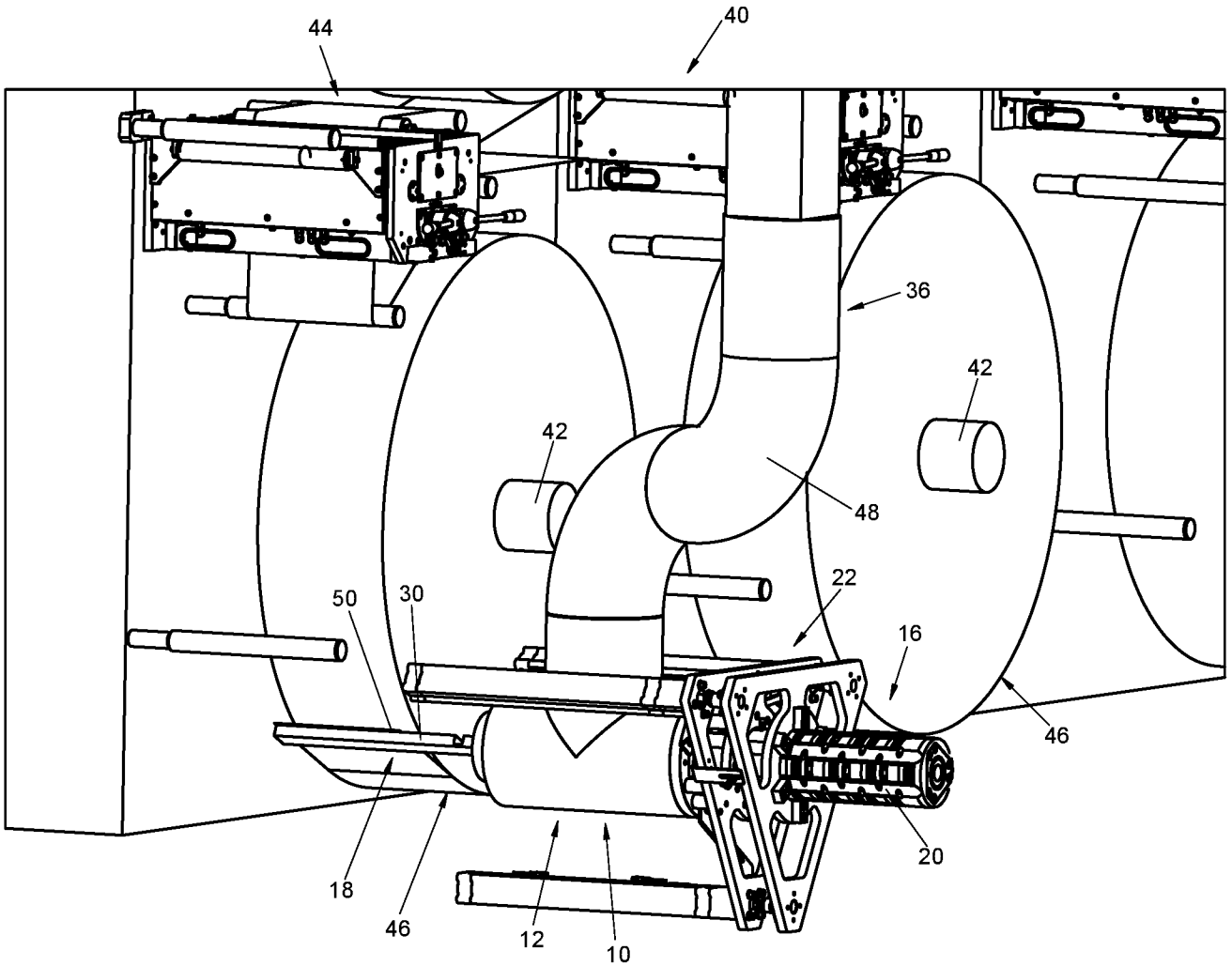

Then, as shown in FIG. 7, the end effector 10 is moved to position the flat surface 32 of the rod 30 in contact with the protective film of the double-sided adhesive tape 50 of the reel 46. The suction holes 34 are then connected to a sub-atmospheric pressure source to grip by suction the head edge of the web material.

Figure 8:
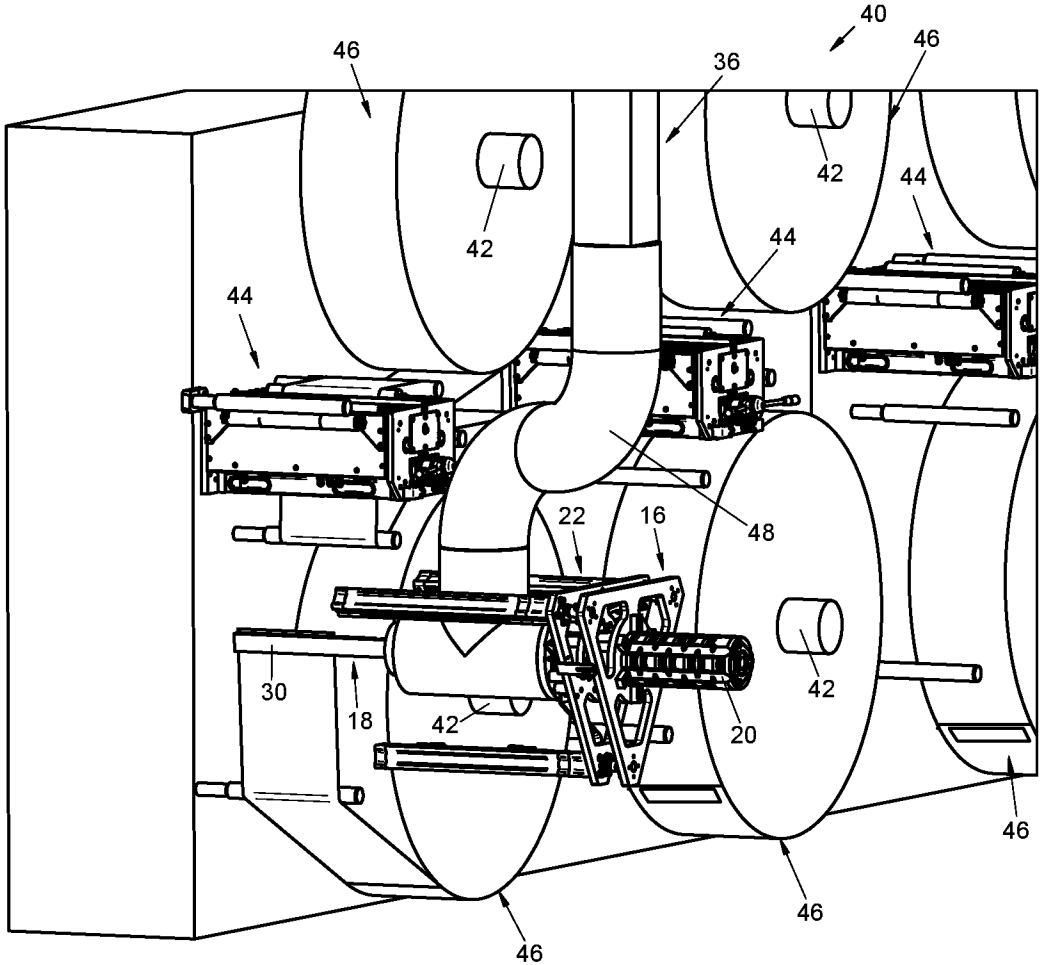
Figure 9:
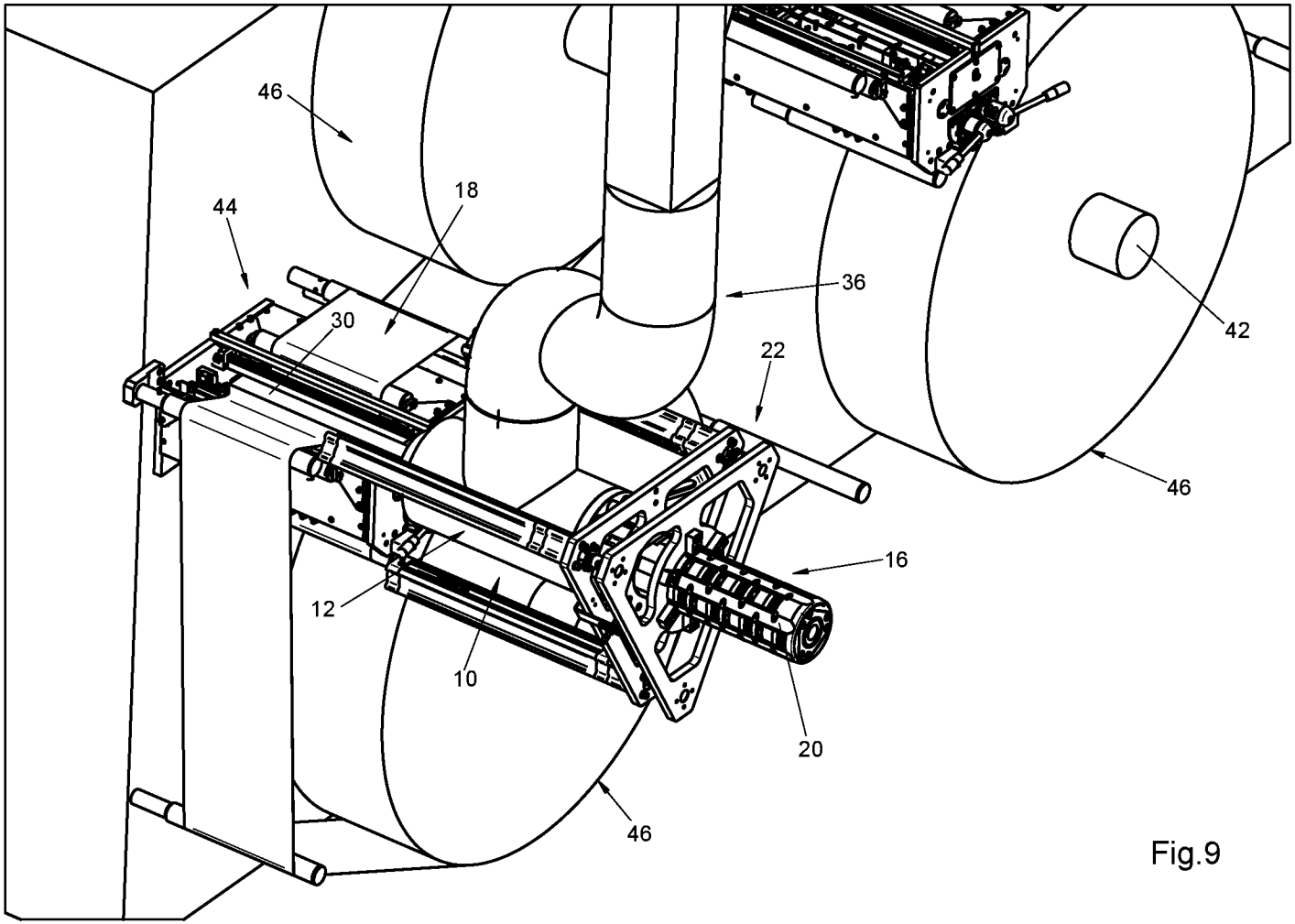

Then, as shown in FIGS. 8 and 9, the end effector 10 is moved to position the head edge of the web material over a retaining element of a respective splicer 44. The retaining element of the splicer 44 may grip the head edge of the web material by suction. The splicer 44 may have a section which opens and closes automatically for facilitating threading the head edge of the web material in the splicer 44.

Figure 10:
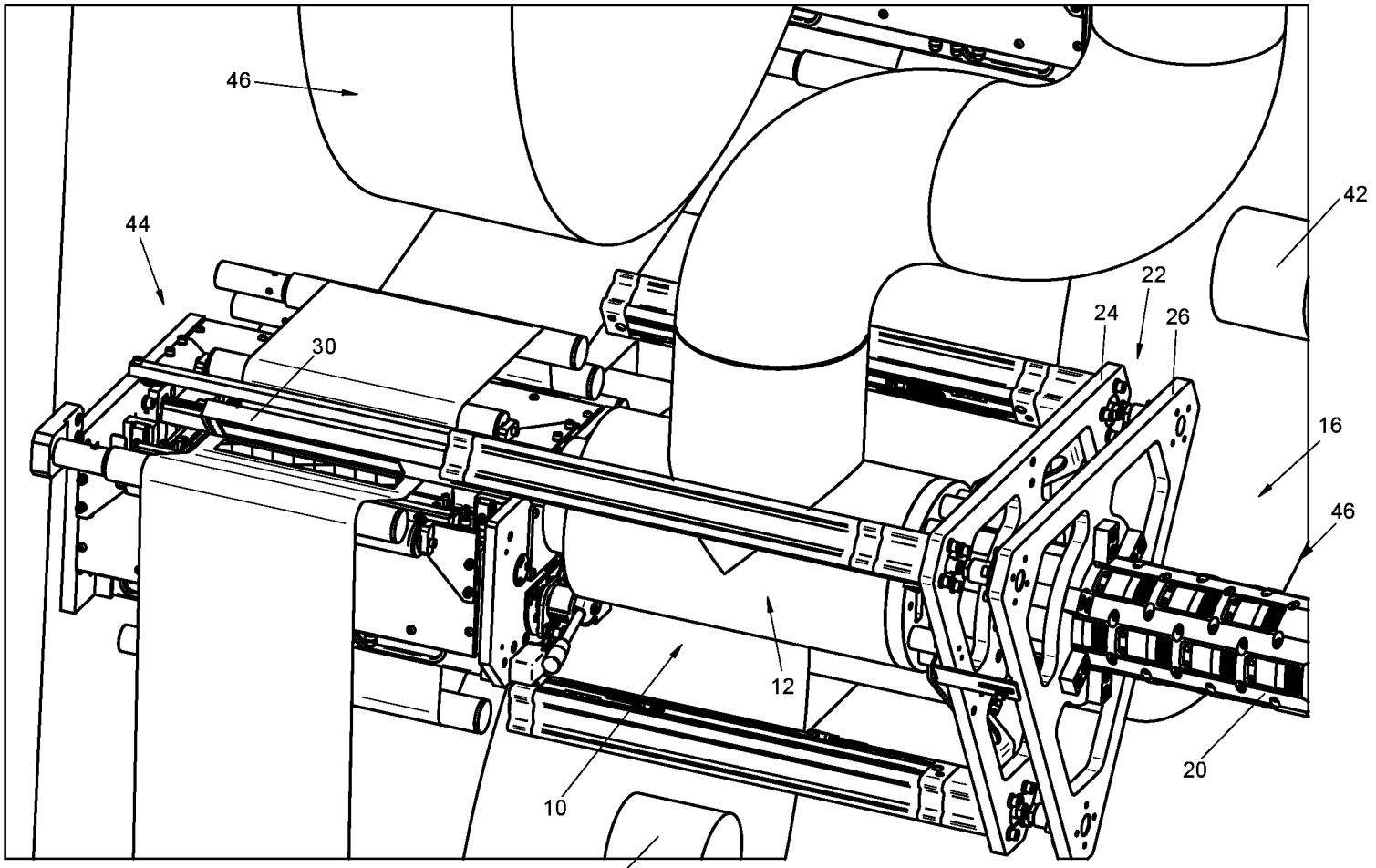

Then, as shown in FIG. 10, the end effector 10 is moved away from the retaining element of the splicer 44 while keeping the suction holes 34 in suction mode.

The suction force that holds the head edge of the web material to the retaining element of the splicer 44 and the suction force that holds the protective film of the double-sided adhesive tape 50 to the rod 30 of the end effector 10 are both greater than the force necessary for peeling the protective film from the double-sided adhesive tape 50. Therefore, when the rod 30 of the end effector 10 is moved away from the retaining element of the splicer 44 the protective film is removed from the double-sided adhesive tape 50, thereby leaving exposed the outer adhesive surface of the double-sided adhesive tape 50.

Figure 11:
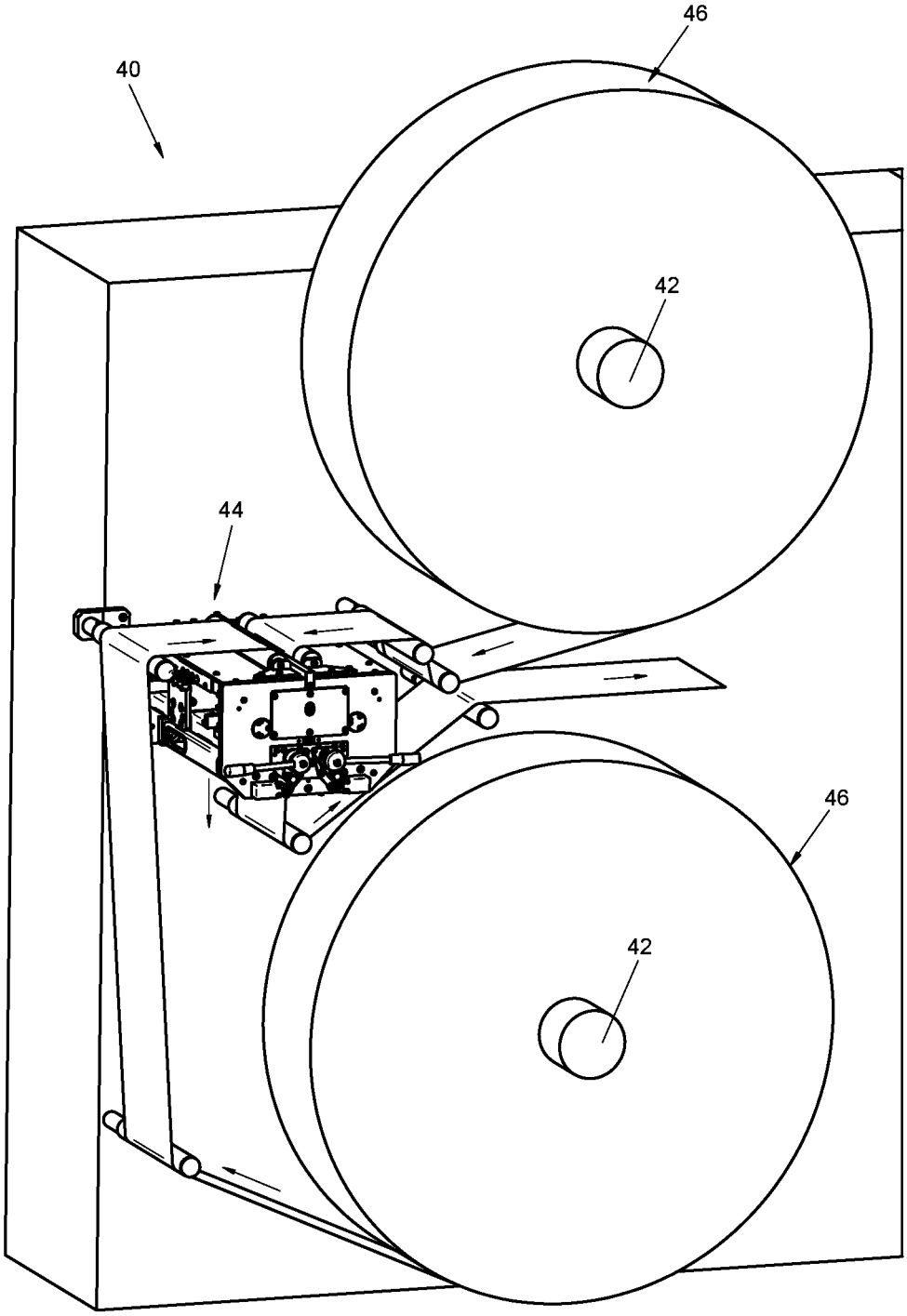
FIG. 11 is a perspective view showing an unwinding unit ready for splicing the web materials of two reels.

At this point, as shown in FIG. 11, the head portion of the new reel 46 is ready to be spliced to the tail portion of a web material unwound from a reel 46 that is close to finishing. The head portion of the new reel 46 is kept in a stand-by position until the reel currently being unwound is close to finishing. When the old reel is close to finishing the splicer 44 is actuated to splice the head portion of the new reel 46 to the tail portion of the old reel 46 by the double-sided adhesive tape 50.

The end effector 10 may be operated to remove the tubular core of the finished reel from the unwinding shaft 42 of the unwinding unit 40. The removal of the tubular core of the finished reel may be carried out by gripping by suction the tubular core of the finished reel by the rod 30 of the end effector 10. Alternatively, the end effector 10 may be provided with a further tool dedicated to gripping the tubular core of the finished reel.

Possible embodiments relate to an unwinding unit (40) for a converting machine comprising at least first and second unwinding shafts (42), at least one splicer (44) associated to said first and second unwinding shafts (42), and a reel handling robot (36) as previously described.

Possible embodiments relate to a method for handling reels (46) of web material, comprising:

providing a plurality of reels (46) in a storage area (48) each having a continuous web wound around a central through hole (47), said continuous web having a head portion on an outer surface of the reel (46), providing at least first and second unwinding shafts (42) and at least one splicer (44) associated to said first and second unwinding shafts (42), providing a reel handling robot (36) carrying an end effector (10) having a reel picking tool (16) configured for picking a reel (46) and a web gripping tool (18) configured for gripping a head portion of a web on the outer surface of a reel (46), picking up a reel (46) in said storage area (48) by means of said reel picking tool (16) of said end effector (10), positioning said reel (46) on one of said first and second unwinding shafts (42), gripping by means of said web gripping tool (18) the head portion of the web of the reel (46) positioned on one of said first and second unwinding shafts (42), and moving the end effector (10) for positioning said head portion of the web on said splicer (44) and retaining said head portion of the web on said splicer (44).

The method may comprise inserting an expansion shaft (20) of said reel picking tool (16) into the central hole (47) of a reel (46) and expanding radially the expansion shaft (20) to secure the reel (46) to the end effector (10).

Said web gripping tool (18) may comprise a rod (30) provided with suction holes (34), and the method may comprise positioning said rod (30) on the outer surface of the reel (46) at the head portion of the web and connecting said suction holes (34) to a source of sub-atmospheric pressure for gripping by suction said head portion of the web.

A double-sided adhesive tape (50) may be applied on the outer surface of each reel (46) adjacent to the head edge of the web material, the double-sided adhesive tape (50) may have a removable protective film to protect the outer adhesive surface and said rod (30) of said web gripping tool (18) may grip by suction the head portion of the web at the protective film of the double-sided adhesive tape (50).

The head portion of the web may be retained by suction by a retaining element of the splicer (44) while said rod (30) grips by suction the protective film of the double-sided adhesive tape (50), the suction force that holds the head portion of the web material to the retaining element of the splicer (44) and the suction force that holds the protective film of the double-sided adhesive tape (50) to the rod (30) may be both greater than the force necessary for peeling the protective film from the double-sided adhesive tape (50), and the rod (30) of the end effector 10 may be moved away from the retaining element of the splicer (44) while gripping by suction the protective film to remove the protective film from the double-sided adhesive tape (50).

Possible embodiments relate to an electronic control unit (51) having installed therein a software containing instructions for a reel handling robot (36) to carry out a method as previously described.

Of course, without prejudice to the principle of the invention, the details of construction and the embodiments can be widely varied with respect to those described and illustrated, without thereby departing from the scope of the invention as defined by the claims that follow.

The invention claimed is:

1. A reel handling robot for handling reels of web material, comprising a movable arm carrying an end effector, wherein the end effector comprises:

a base connected to said movable arm, a reel picking tool carried by said base and configured for securing a reel to the base, and a web gripping tool carried by said base and configured for gripping a head portion of the web material on an outer surface of the reel, wherein said reel picking tool and said web gripping tool are located on opposite sides of the base.

2. The reel handling robot of claim 1, wherein the reel picking tool includes an expansion shaft configured for being inserted into a central hole of the reel.

3. The reel handling robot of claim 2, wherein said expansion shaft has radially movable engagement elements which expand radially to engage a cylindrical inner surface of the reel.

4. The reel handling robot of claim 1, wherein the web gripping tool includes a rod provided with suction holes connectable to a source of sub-atmospheric pressure for gripping by suction the head portion of the web material on the outer surface of the reel.

5. The reel handling robot of claim 4, wherein said suction holes are provided on a flat surface of said rod.

6. The reel handling robot of claim 1, wherein said movable arm is configured for moving the end effector along three orthogonal axes and for rotating the end effector about the three orthogonal axes.

7. A reel handling robot for handling reels of web material, comprising a movable arm carrying an end effector, wherein the end effector comprises:

a base connected to said movable arm, a reel picking tool carried by said base and configured for securing a reel to the base, and a web gripping tool carried by said base and configured for gripping a head portion of the web material on an outer surface of the reel, wherein the reel picking tool includes an expansion shaft configured for being inserted into a central hole of the reel, and wherein the reel picking tool comprises an extractor device including a first plate fixed to the base and carrying at least one actuator, and a second plate controlled by said at least one actuator and movable along an axis of the expansion shaft between a retracted position and an extracted position.

* * * * *